US005470273A

United States Patent [19]

Mertens

[11] Patent Number: 5,470,273

[45] Date of Patent: Nov. 28, 1995

[54] GRINDING WHEEL FOR SURFACE CUTTING OF WORKPIECES

[75] Inventor: Udo Mertens, Halstenbek, Germany

[73] Assignee: Ernst Winter & Sohn (GmbH & Co.), Hamburg, Germany

[21] Appl. No.: 159,445

[22] Filed: Nov. 29, 1993

[30] Foreign Application Priority Data

Dec. 2, 1992 [DE] Germany ..... 42 40 476.2

[51] Int. Cl.[6] ..... B24D 7/06

[52] U.S. Cl. ..... 451/548; 451/550; 451/540

[58] Field of Search ..... 451/319, 540, 451/548, 550, 552, 259

[56] References Cited

U.S. PATENT DOCUMENTS

| | | | |
|---|---|---|---|
| 2,724,222 | 11/1955 | Jeppson . | |
| 3,343,306 | 9/1967 | Highberg | 51/110 |
| 4,918,872 | 8/1990 | Sato et al. | 51/209 R |
| 5,060,424 | 10/1991 | Sato et al. | 51/209 R |
| 5,247,765 | 9/1993 | Quintana | 451/548 |

OTHER PUBLICATIONS

JP 63–312052 A2, Patent Abstracts of Japan. vol. 13, No. 153 (1989).

JP 62–255069 (A), Patents Abstracts of Japan, vo. 12, No. 131 (1989).

*Primary Examiner*—Bruce M. Kisliuk
*Assistant Examiner*—Eileen P. Morgan
*Attorney, Agent, or Firm*—Vidas, Arrett, & Steinkraus

[57] ABSTRACT

The present invention relates to a grinding wheel for surface cutting of workpieces, comprising a carrier wheel and an abrasive lining which is composed of a plurality of individual hexagonal and equilateral grinding portions which are secured to the carrier plate.

7 Claims, 4 Drawing Sheets

GRINDING WHEEL FOR SURFACE CUTTING OF WORKPIECES

BACKGROUND OF THE INVENTION

The present invention relates to a grinding wheel for surface cutting of workpieces.

U.S. Pat. No. 3,343,306 discloses a grinding wheel having an annular abrasive lining arranged in a plane. Annular carrier sheets are screwed on an annular carrier wheel, the sheets holding a plurality of concentrically arranged rectangular portions for the abrasive lining. The sides of the segments facing each other are straight, while the peripheral sides each are circularly curved. Grooves for passing a cooling fluid are provided between the portions and the individual rings.

The shape of a grinding wheel of this type or, respectively, of its grinding surface is substantially defined by its inner and outer diameter which have to be selected according to the desired application (grinding wheel geometry). For example, three rings each including grinding portions are provided for the grinding surface of the known grinding wheel referred to. With a view to shaping the grinding portions, this means that three sets of differently dimensioned portions are required. When the inner and/or outer dimensions are changed, new sets of grinding portions are required. Thus, each grinding wheel geometry requires individual sets of grinding portions resulting in a substantial expenditure in manufacturing and storing.

Referring to the prior art grinding wheel, the grinding portions and rings are arranged in a distance from each other for passing a cooling fluid therebetween. The annular grooves prevent overlapping in the peripheral direction such that the shape of the annular groove may be reproduced on the workpiece which is not desirable.

The known grinding wheel is further affected by a geometry in which the distances or grooves between the grinding portions are initially reflected. The grooves cannot be changed for a predetermined geometry and corresponding dimensions of the portions. The width of the grooves between the portions should be selected as small as possible for relatively small workpieces. In other cases a larger width is desired. Thus the known grinding wheel may be used only for workpieces having a certain size.

U.S. Pat. No. 4,918,872 as well as U.S. Pat. No. 5,060,424 disclose a grinding wheel having a lining which is composed of trapezoidal portions which are arranged in sectors. Grooves are provided between the portions and between the individual sectors. The grooves between the grinding portions arranged in a sector extend approximately parallel and along a chord. Thus the danger of a lacking overlap when performing a peripheral and/or tangential forward feed is avoided. The radial extension of the grooves between the sectors, however, results in a fast draining of the cooling fluid which is not desired.

Still further, each grinding portion in a sector has necessarily a different contour. Accordingly, as many sets of grinding portions are required as grinding portions are provided in the sectors. Furthermore, a change of the grinding wheel geometry requires differently shaped sets of grinding portions so that for a predetermined number of differently dimensioned working surfaces, a correspondingly large number of differently shaped portions must be manufactured. Since the portions are mostly produced by means of molds, a correspondingly high number of different molds is required.

The grinding portions disclosed in the references referred to necessarily include acute angles. When portions of this type are produced e.g. by a sintering or ceramic burning process as commonly conventional, there is the danger that tensions are created in particular in the area of the acute angles which might result in fractures when the portions are subsequently handled or ground what might involve great dangers to workmen, for example. Acute angles further exhibit the disadvantage that the steel mold required for briquetting possibly cannot be uniformly filled. After the molding process, a varying hardness of the grinding portions must be expected. Furthermore, it is difficult or even impossible to check grinding portions within the region of acute angles for hardness and density as fractures may easily occur. Still further, acute angle grinding portions are subjected to damages when automatically applied. They suffer from a varying heating up during machining and exhibit a non-uniform shrinking behaviour when being manufactured.

SUMMARY OF THE INVENTION

It is an object of the invention to provide a grinding wheel for surface cutting of workpieces.

It is a further object of the invention to provide a grinding wheel having a grinding surface which is composed of uniformly shaped grinding portions not regarding the dimension of the grinding surface.

According to the invention, the grinding portions forming the grinding surface have an equilateral hexagonal shape defining a certain width across flats "SW". The length of the sides may be 10 to 20 mm, for example. The size of the hexagonal portions, however, is not important. The size is rather selected under the aspect of the range of dimensions of the respective annular grinding surface. It is appropriate to select the dimension such that in the radial direction between the inner and outer periphery of the grinding surface, there is a plurality of grinding portions.

The hexagonal shape has the advantage that an annular grinding surface may be lined with uniform grinding portions independent of the inner and outer diameter. Moreover, the distances between the grinding portions may be voluntarily selected, as machining and size of the workpieces to be ground may require.

As referred to above, grooves may be provided between the grinding portions. The width of the grooves may be the same across the total grinding surface. Alternatively, the grooves may have a differing width which, for example, may increase or decrease from inside to outside. However, it is possible to even eliminate the grooves when lining the grinding surface.

When the hexagonal grinding portions having uniform dimensions are secured to a carrier wheel within a predetermined angular ring, it cannot be avoided that a somewhat larger number of portions more or less projects over the inner and outer periphery. However, there are no problems to remove the projecting sections by an appropriate machining.

The uniform grinding portion according to the invention may exhibit equal constitution of material. However, since the grinding conditions are dependent of the diameter among others (different peripheral speeds), it may be desirable to provide a varying constitution or characteristics to the grounding portions from inside to outside, for example by providing varying grain sizes of the abrasive, a varying abrasive concentration or combined composition to provide uniform grinding conditions across the diameter of the grinding surface. On the other hand, it may be desirable to obtain different grinding effects in varying ranges of diameter, for example to obtain a coarser grinding radially inwardly and a finer cutting radially outwardly. This can be obtained by varying the grain size or concentration for the abrasive in the grinding portions.

The grooves provided between adjacent grinding portions define fluid passages through which a cooling fluid can pass which could be applied from the inner side of the wheel, for example. The profile of the fluid passages due to the hexagonal shape results in a relatively long retention time of the cooling fluid until it runs off from the periphery. According to a further aspect of the invention, the retention time may be further increased by partly or completely closing the radially outwardly opening grooves (that is, the grooves which intersect the outer circumference of the wheel), for example by means of an adhesive which is also used for securing the grinding portions to the carrier wheel. According to a further embodiment of the invention, the adhesive may be distributed within the grooves such that the level of the adhesive in the grooves increases from inside to outside (that is, moving radially on the wheel toward the outer circumference of the wheel). By partly filling up the grooves, passages of different cross-section from inside to outside are obtained, thus providing for a desired flow control of the cooling fluid between the grinding portions. Often the so-called "flooding over" of the grinding surface with cooling fluid is desired. This effect may be also obtained with the features explained.

The invention provides for a number of substantial advantages.

Thus the hexagonal shape of the grinding portions makes it possible to select standard dimensions for the grinding portions independent of the wheel geometry. An overlapping in the peripheral as well as the tangential direction in machining is always safely obtained.

Furthermore, the hexagonal shape of the grinding portions according to the invention has the advantage that they can be manufactured, for example by a sintering or a ceramic burning process, substantially free of tensions as the angles defining the shape are obtuse so that the danger of cracking or fractures is very low. Also the filling of steel molds in manufacturing hexagonal portions will take place uniformly so that a uniform hardness and density across the dimensions of the grinding portions may be obtained. Still further, hexagonal portions can be easily checked for hardness and density, while there is no danger of fracturing. The hexagonal shape also facilitates a uniform shrinkage and a more uniform heating behaviour in manufacturing.

A particular advantage originates from the uncomplicate production of grinding surfaces having different dimensions. Corresponding to the standard shape of the grinding portions, a standard forming tool only is required for manufacturing.

DETAILED DESCRIPTION OF THE PREFERRED EMBODIMENT

Figure 1:
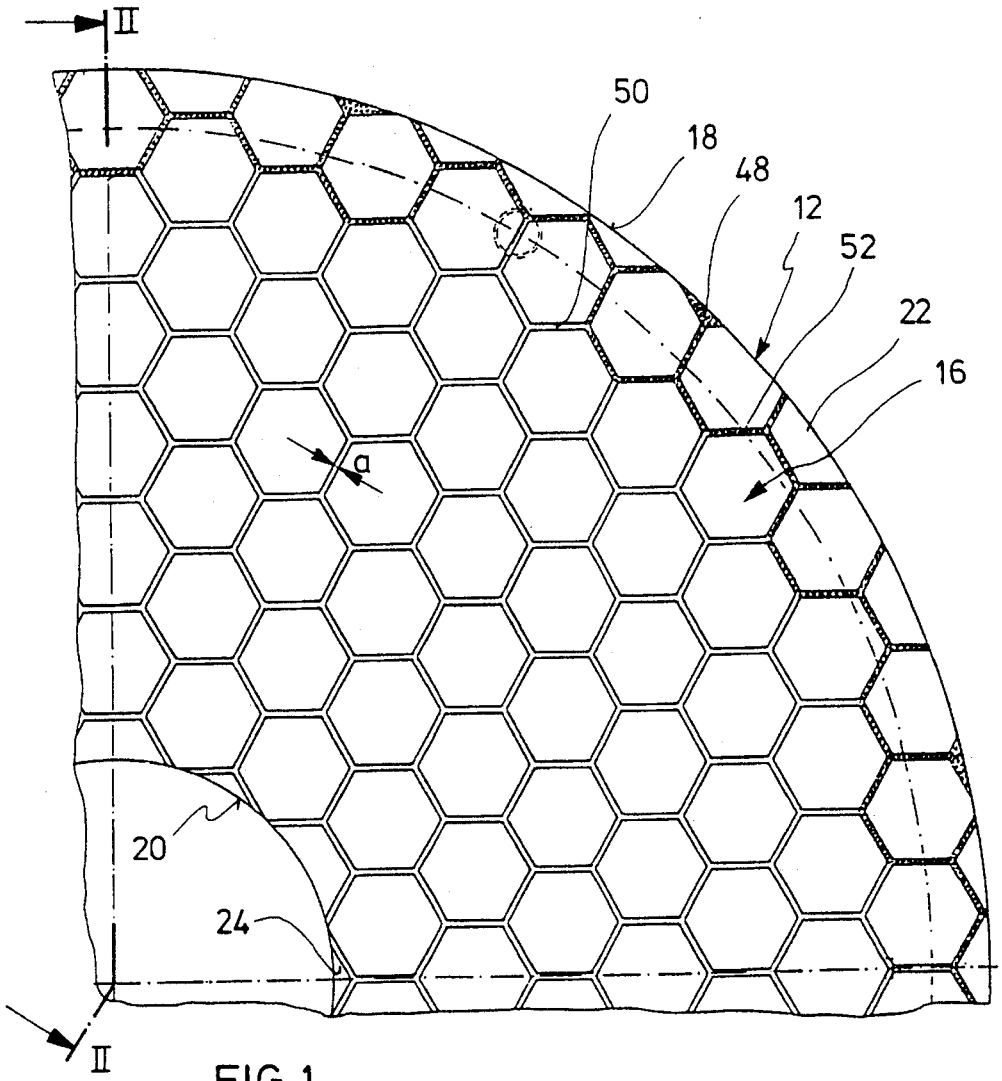
FIG. 1 is a plane view of a section of a grinding wheel according to the invention.
Figure 2:
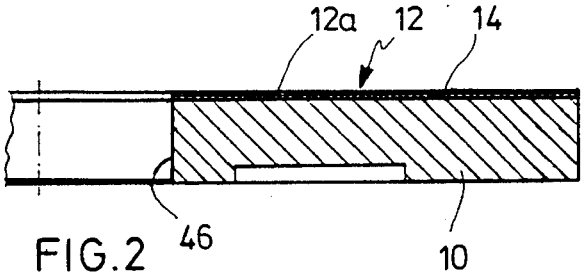
FIG. 2 is a sectional view through the grinding wheel of FIG. 1 along the line 2—2.
Figure 3A:
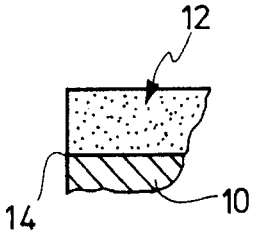
FIGS. 3 and 3*a* are details of the grinding wheel of FIG. 2.
Figure 3:
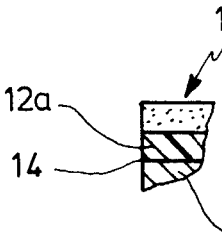

FIGS. 1 and 2 show a ring cylindrical carrier wheel 10 to which an abrasive lining 12 possibly including a substrate 12*a* free of hard material is attached by means of an adhesive layer 14. The structure of the grinding wheel is shown in FIG. 3 and FIG. 3*a* to some detail.

The plane view of FIG. 1 more clearly shows the arrangement of the abrasive lining 12. As can be seen, the abrasive lining comprises a plurality of equilateral, hexagonal grinding portions 16 having an identical, geometrical configuration. The grinding portions are made from a suitable abrasive material, e.g. by an appropriate briquetting and/or sintering process. The portions have a predetermined constant thickness, i.e. its grinding surface and its supporting surface are plane parallel. The portions are located in a predetermined distance "a" from each other. The distance "a" may be varied, for example, between 0 and 5 mm. The annular abrasive surface 12 is limited by an outer periphery 18 and an inner periphery 20. As can be seen, most of the grinding portions extending around the peripheries 18, 20 are not complete as shown at 22 and 24. This is based on the arrangement of the abrasive lining as an abrasive surface as it will be described with reference ti FIGS. 4*a* to 6.

Figure 4:
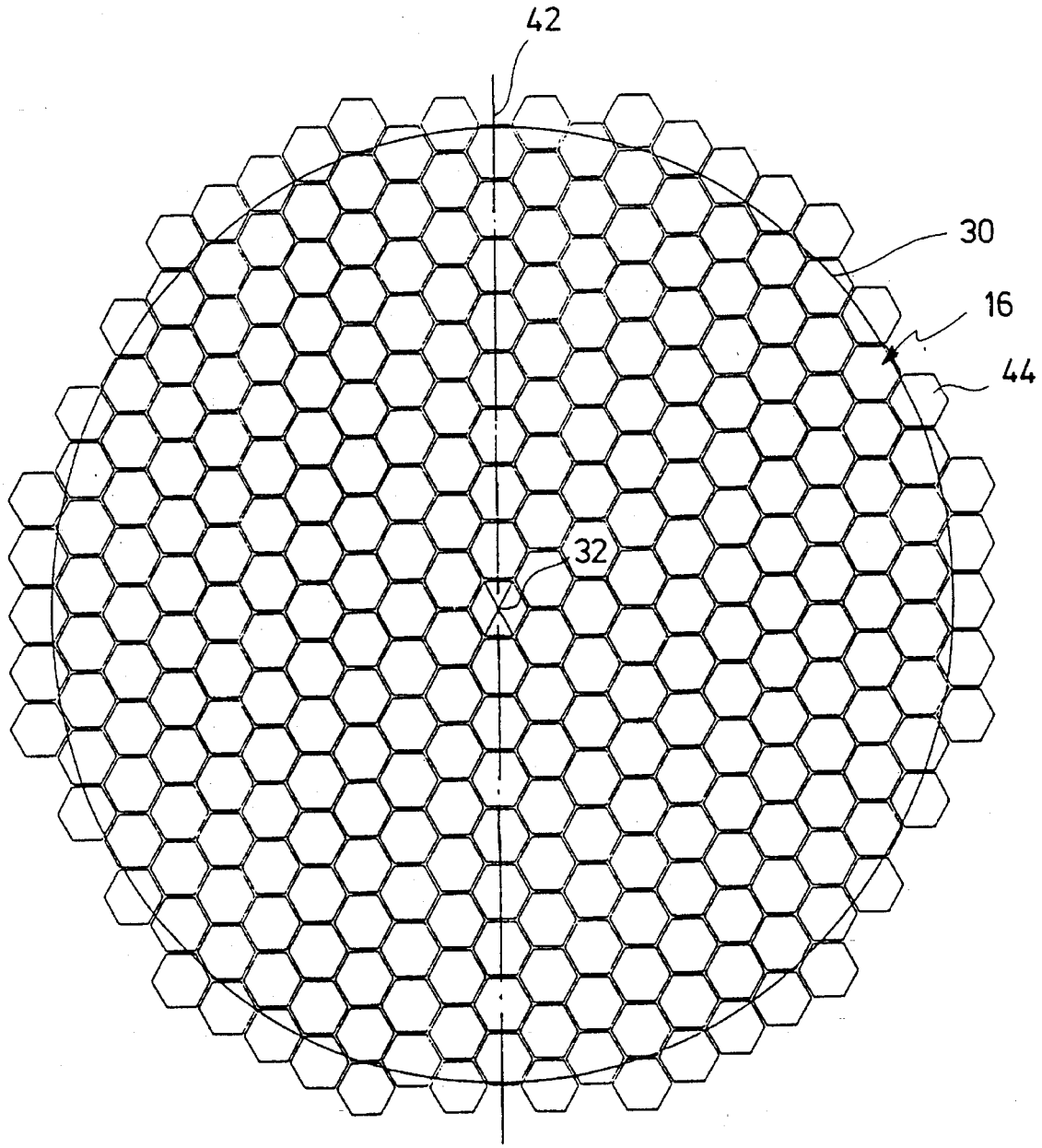
FIG. 4 is a plane view of a grinding wheel according to the invention showing the abrasive lining during a step of manufacturing.
Figure 4A:
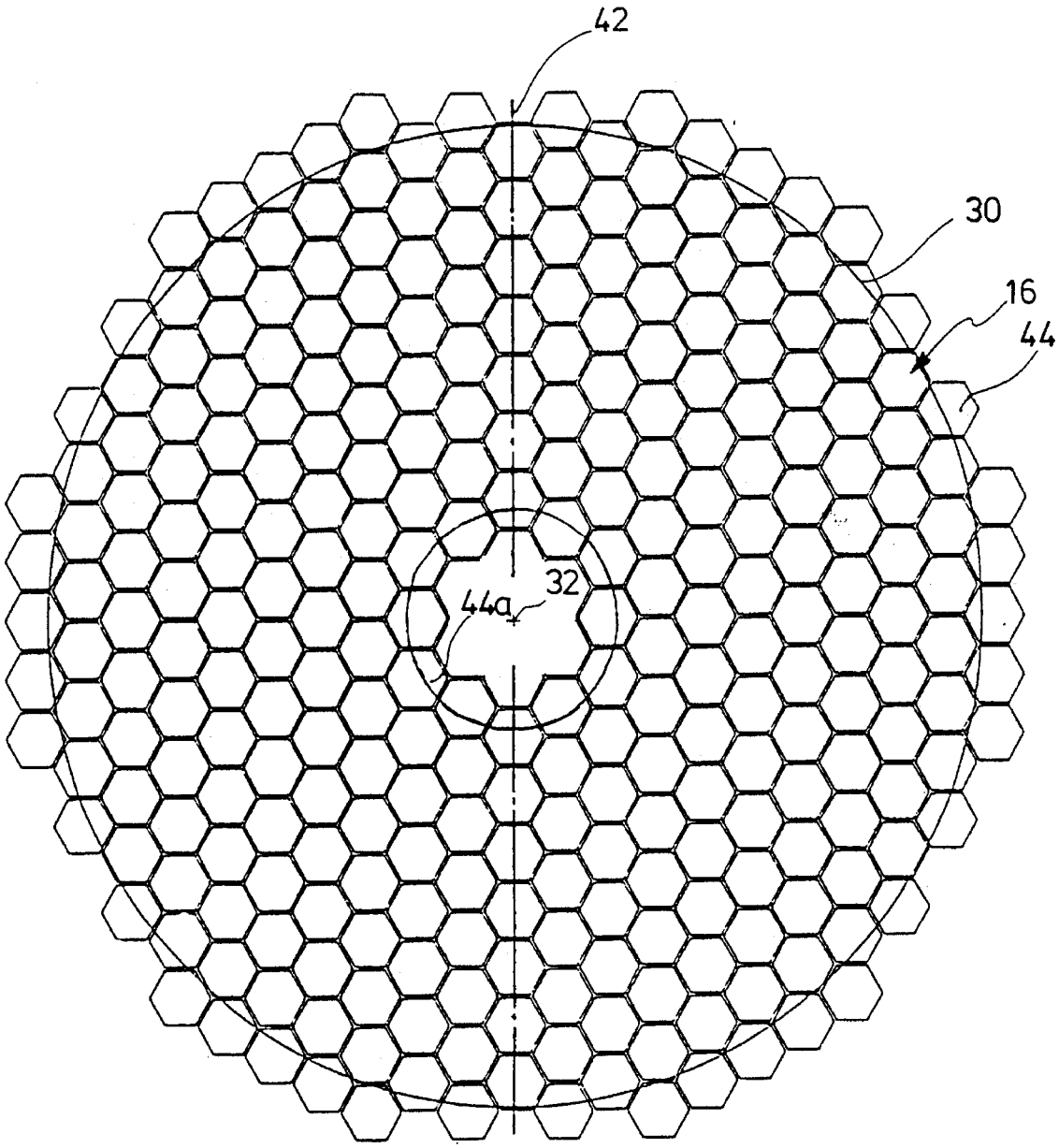
FIG. 4*a* is a plane view of a similar grinding wheel having a central aperture.
Figure 5:
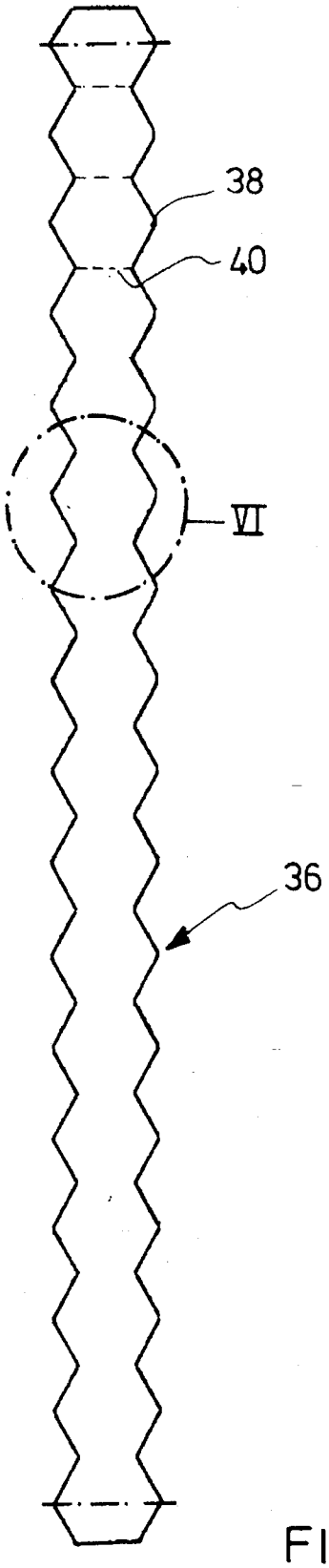
FIG. 5 is a plane view of a tool for attaching the abrasive lining.
Figure 6:
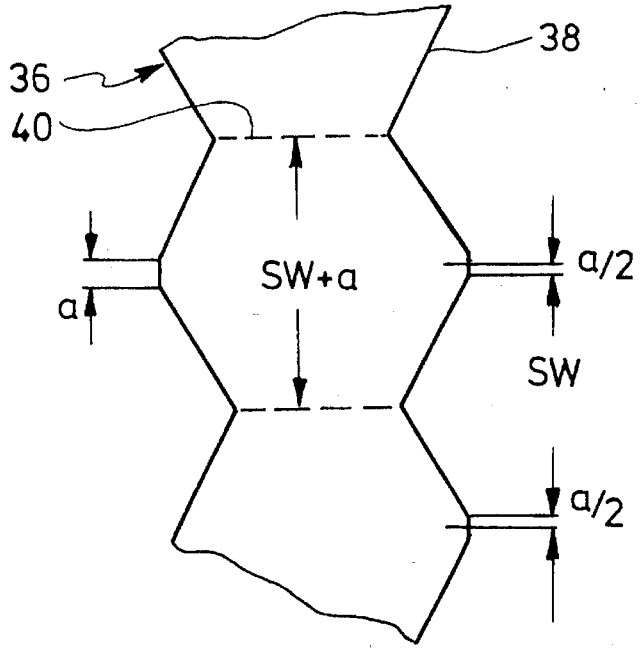
FIG. 6 is a view of the detail 6 of FIG. 5.

A carrier wheel has a circular periphery 30 (FIGS. 4 and 4*a*). The center is shown at 32. A template 36 (FIG. 5) is provided with a toothing 38 extending along both longitudinal sides, wherein the toothing at either side corresponds to the shape of hexagons facing each other when arranged side by side (FIG. 6). The width across flats of the hexagons plus the distance "a" corresponds, for example, to the width across flats of the template toothing as shown in broken lines 40 (FIG. 6). The template described is for example diametrically placed across the carrier wheel 30, as the dot-dashed line 42 shows (FIG. 4). The grinding portions 16 will be then placed into the recesses of the toothing 38 and will be secured by an adhesive. Subsequently, the template 36 is removed so that further grinding portions 16 may be placed into further recesses. It should be understood that the template 36 is dimensioned to take account of a desired distance "a" between the portions 16 so that the desired groove will be obtained when the portions for an intermediate row are placed between parallel rows of portions 16. Thereafter the template 36 may be placed along a row of portions 16 already secured in order to attach a further row of portions.

It should be understood that the circular surface defined by the periphery 30 is completely covered with grinding portions 16. This results in a more or less larger projection of individual grinding portions 16 almost through the complete periphery of the grinding surface. The protruding sections as shown at 44 and 44*a* (FIG. 4*a*) for example, may be cut off by an appropriate machining.

Adjusting the portions to an annular grinding surface may be also made before securing them to the carrier body.

Multiple turned channels for passing the cooling fluid are formed by providing a distance "a". The cooling fluid is thus held within the grinding surface 12 through a substantial dwelling time. To prevent a running-off too fast and to obtain the desired feature of flooding the grinding portion 16, the grooves outwardly opening may be closed, for example with an adhesive as shown at 48. The groove 50 can further be filled with adhesive as shown at 52. It is thus possible to voluntarily vary the flow cross-section through the grooves 50, for example to form a flow passage which flow cross-section decreases from inside to outside. This compensates for the geometry that the flow cross-section becomes larger from inside to outside when the cooling fluid is applied to the inside.

The grinding portion 16 may be made of uniform material having uniform grain and consistency. However, it is possible to provide varying hard and dense portions having a varying grain in order to change the specification of the grinding portions 16 with respect to its wear quality from inside to outside, for example to keep the wear quality constant for different peripheral speeds or, respectively, to provide for a varying wear.

What is claimed is:

1. A grinding wheel having an axis and an inner and outer circumference, and a grinding surface extending in a plane perpendicular to the axis of said wheel for surface machining of workpieces, said wheel comprising a carrier body and an annular abrasive lining attached to said carrier body and defining said plane grinding surface, said abrasive lining comprising a plurality of individual separate hexagonal and equilateral grinding portions which have been attached one after the other to said carrier body such that, when attached, some sections of said individual grinding portions had projected radially and/or outwardly beyond said grinding wheel circumferences and said and/or radially outward projecting sections have been removed by machining whereby after machining, the grinding portions along the inner and/or outer circumferences are no longer complete equilateral hexagons.

2. The grinding wheel of claim 1 wherein grooves are provided between said individual grinding portions.

3. The grinding wheel of claim 2, wherein said grooves have equal widths.

4. The grinding wheel of claim 3, wherein some of the grooves open radially outwardly at said outer circumference and the grooves which open radially outwardly are partly or fully filled.

5. The grinding wheel of claim 4, wherein the partly or fully filled grooves are filled with an adhesive.

6. The grinding wheel of claim 1, wherein the grinding portions are secured to said carrier body by an adhesive, and wherein grooves are provided between said individual grinding portions, said adhesive being provided in said grooves up to a level such that the level of the adhesive in said grooves increases from radially inside to radially outside of said wheel.

7. The grinding wheel of claim 1, wherein the consistency of the material from which said individual grinding portions are produced varies in at least one property of density, grain or hardness from radially inside to radially outside of said wheel.

* * * * *